US005715324A

United States Patent [19]

Tanabe et al.

[11] Patent Number: 5,715,324

[45] Date of Patent: Feb. 3, 1998

[54] SPEAKER HAVING MAGNETIC CIRCUIT

[75] Inventors: Kei Tanabe, Iwaki; Nobuo Kakinuma, Hanyu; Shigeki Takei, Fukaya, all of Japan

[73] Assignee: Alpine Electronics, Inc., Tokyo, Japan

[21] Appl. No.: 774,982

[22] Filed: Dec. 26, 1996

Related U.S. Application Data

[63] Continuation of Ser. No. 368,828, Jan. 5, 1995, abandoned.

[30] Foreign Application Priority Data

Jan. 5, 1994 [JP] Japan ..... 6-000138

[51] Int. Cl.[6] ..... H04R 25/00

[52] U.S. Cl. ..... 381/199; 381/195; 381/194; 381/204

[58] Field of Search ..... 381/199, 202, 381/195, 192, 204, 194

[56] References Cited

U.S. PATENT DOCUMENTS

| | | | |
|---|---|---|---|
| 2,512,323 | 6/1950 | Gersch . | |
| 3,201,529 | 8/1965 | Surh | 381/199 |
| 4,337,379 | 6/1982 | Nakaya | 381/202 |
| 4,475,014 | 10/1984 | King . | |
| 5,452,366 | 9/1995 | Sakamoto et al. | 381/199 |
| 5,550,332 | 8/1996 | Sakamoto | 181/148 |

FOREIGN PATENT DOCUMENTS

| | | | |
|---|---|---|---|
| 0214198 | 10/1985 | Japan | 381/194 |

*Primary Examiner*—Sinh Tran
*Attorney, Agent, or Firm*—Guy W. Shoup

[57] ABSTRACT

A speaker in which the inner peripheral face of a ring-shaped soft ferrite core is cemented to a cylindrical projection extending from a lower portion of a bowl-shaped frame. An outer peripheral surface of a co-axially disposed ring-shaped bond magnet is fitted into a recess of the frame. Two magnetic gaps are formed between facing surfaces of the ring-shaped bond magnet and the ring-shaped soft ferrite core. Two voice coils are mounted on a cylindrical bobbin and suspended from a vibratory diaphragm such that the voice coils are inserted into the magnetic gaps.

19 Claims, 7 Drawing Sheets

SPEAKER HAVING MAGNETIC CIRCUIT

This application is a continuation of application Ser. No. 08/368,828, filed Jan. 5, 1995 now abandoned.

BACKGROUND OF THE INVENTION

1. Field of the Invention

The present invention relates to an improvement in a magnetic circuit of a speaker and more particularly to a magnetic circuit of a speaker which reduces high-frequency distortion.

2. Description of the Related Art

FIG. 7 is a section view of a conventional speaker. Referring to FIG. 7, reference numeral 74 denotes a ring-shaped sintered ferrite magnet which is anisotropic along the axial direction (the vertical direction in the figure). The sintered ferrite magnet 74 is clamped by a ring-shaped iron plate 73 and an iron yoke 77 to form a magnetic circuit. A cylindrical pole section 771 is integrally provided at the central upper face of the yoke 77. A magnetic gap 79 is provided between the outer periphery of the pole section 771 and the inner periphery of the ring-shaped plate 73. A voice coil 76 which is wound upon a bobbin 75 is inserted in this magnetic gap 79. The inner periphery of a virtually conical vibratory diaphragm and the inner peripheral portion of a damper 78 are each secured to the upper portion of the bobbin 75 by cement. The outer peripheral sections of the vibratory diaphragm 72 and damper 78 are supported by a frame 71, which is also formed in a virtually conical shape from, for example, an iron plate. The illustrated lower end portion of the frame 71 is secured to the upper face of the ring-shaped plate 73 by such a method as caulking, whereby the frame 71 is fixed onto the magnetic circuit. Applying voice current to the voice coil 76 causes the diaphragm connected to the voice coil 76 by means of the bobbin 75 to vibrate, which results in the production of sound.

In the aforementioned conventional speaker, the ring-shaped iron plate 73 and the iron yoke 77 are used as component parts of the magnetic circuit. Therefore, the magnetic field of the voice coil 76 produced by applying voice current (alternating current) thereto develops eddy currents in the ring-shaped plate 73 and the yoke 77 which define the magnetic gap 79. These eddy currents are the primary cause of sound distortion.

The very low inductance of the voice coil 76 increases to a high value when it is placed close to the ring-shaped iron plate 73 and the iron yoke 77. Therefore, the impedance increases from the intermediate-frequency to high-frequency ranges, which leads to reduced sound conversion efficiency. At the same time, phase rotation increases due to impedance, which causes a distortion in the output sound phase.

Further, since iron has a high specific gravity, it is difficult to make the speaker lighter in weight as a whole, and to increase corrosion resistance.

In the conventional speaker, the direction of the magnetic field developed by the magnet 74 is changed by the ring-shaped iron plate 73 and the iron yoke 77 to define the magnetic gap 79. Because iron has a high magnetic permeability, the conversion efficiency in the gap is poor and flux leakage often occurs.

Further, in assembling the magnetic circuit of the aforementioned conventional speaker, first, the pole section 771 of the yoke 77 is arranged coaxially with the sintered ferrite magnet 74. Therefore, it is necessary to position the sintered ferrite magnet 74 on the yoke 77 by matching the central positions using a first jig. Then, a second jig must be used to accurately form the ring-shaped magnetic gap 79 by disposing the ring-shaped plate 73 around the outer periphery of the pole section 771 while aligning the central opening of the plate 73. This process takes a long time to complete, thereby increasing the assembly time of the magnetic circuit, which increases the production cost of the speaker.

In securing the frame 71 to the ring-shaped plate 73 by caulking, iron powder is produced which adheres onto the sintered ferrite magnet 74 or other portions of the magnetic circuit. In such a case, it takes a long time to remove the iron powder, which further increases production costs.

SUMMARY OF THE INVENTION

In view of the above-described problems, the present invention is aimed primarily at reducing sound distortion produced by prior art speakers, and to make a speaker which is lighter in weight and exhibiting improved corrosion resistance. In addition, the present invention simplifying the task of assembling the speaker.

In accordance with the present invention, a cylindrical magnetic member and a cylindrical magnet structure are received in an annular recess integrally formed in a base of a speaker frame. The base includes a central cylindrical projection over which one of the magnet and the magnetic member are located. The base also includes a cylindrical outer wall which receives the other of the magnet and the magnetic member. Assembly is thereby greatly simplified because the magnet and the magnetic member are co-axially mounted on the frame without the need for special jigs.

Further, the speaker includes a vibratory diaphragm disposed within the frame, a cylindrical bobbin connected to the diaphragm, and a voice coil which is wound upon the bobbin and inserted in a magnetic gap formed directly between the peripheral faces of the cylindrical magnet and the cylindrical magnetic member.

The speaker produced in accordance with the present invention reduces leakage flux and thereby increases flux efficiency. In addition, because it is not necessary to connect iron plates to the magnet of the prior art, the total number of parts of the speaker is reduced, and assembly is greatly simplified.

DESCRIPTION OF THE PREFERRED EMBODIMENTS

Embodiments of the present invention will be described below with reference to the drawings.

First Embodiment

Figure 1:
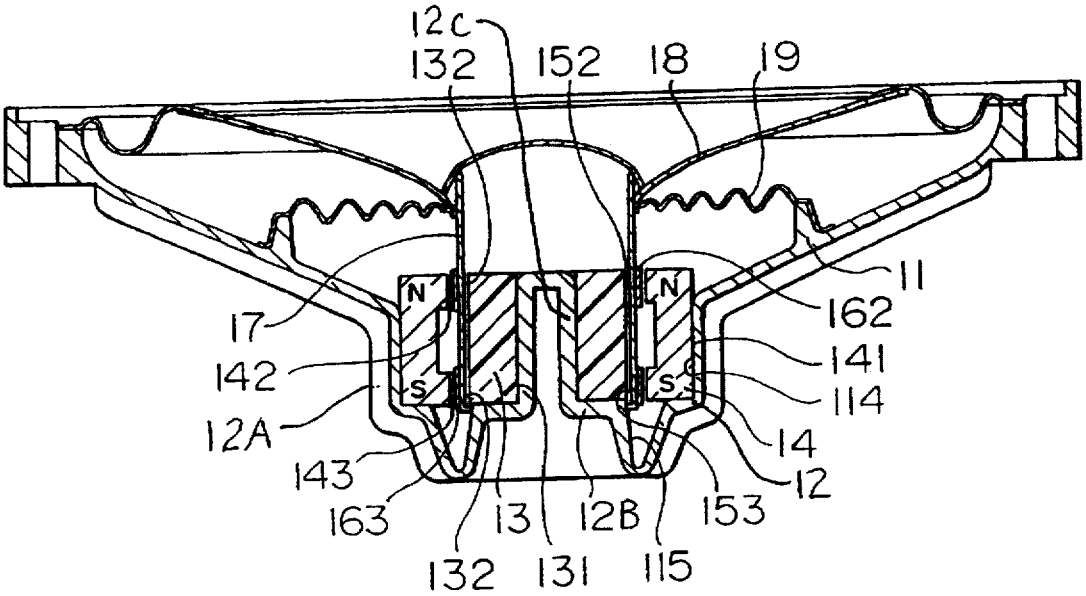
FIG. 1 is a section view showing a speaker according to a first embodiment of the present invention.

FIG. 1 is a cross section of a speaker according to a first embodiment of the present invention.

Reference numeral 11 denotes a virtually bowl-shaped frame having a base 12 and a conical portion extending (upwardly) from the base 12. A ring-shaped (cylindrical) magnetic member 13 and a ring-shaped (cylindrical) bond magnet (magnet structure) 14 are coaxially received in a recess 114 formed by the base 12. A virtually conical vibratory diaphragm 18 and a damper 19 are connected at their respective outer peripheral edges to the conical portion of the frame 11. A cylindrical bobbin 17 is connected at a first (upper) end to an inner peripheral section of the diaphragm 18 and secured thereto by cement. A voice coil including voice coil portions 162 and 163 is mounted on the bobbin 17. Voice coil portions 162 and 163 are connected such that voice current flow through each of voice coil portions 162 and 163 causes vibration of the diaphragm in the illustrated vertical dimension, thereby producing sound.

The base 12 includes an outer cylindrical wall 12A connected to the cone, a bottom wall 12B connected to the outer cylindrical wall 12A, and an inner cylindrical portion 12C connected to the bottom wall 12B and protruding (upwardly) into the cone. The outer cylindrical wall 12A, the bottom wall 12B and the inner cylindrical portion 12C define a recess 114 having a virtually W-shaped cross section. The frame 11 is preferably made from a synthetic resin such as ABS or from aluminum die-cast. Space 115, which is formed by the lower wall 12B and located below the recess section 114 of frame 11, is provided for allowing downward movement of the voice coil portion 163.

The magnetic member 13 includes a central opening having a diameter which is substantially the same as an outer diameter of the inner cylindrical portion 12C such that an inner peripheral face 131 of the magnetic member 13 fits snugly against an outer surface of the inner cylindrical member 12. The magnetic member 13 is secured to the inner cylindrical portion 12C by cement. A soft ferrite core made of a light-weight oxide, such as MnZn ferrite or NiZn ferrite, is used for the magnetic member 13.

The bond magnet 14 includes an outer peripheral face 141 which has bonded thereon NdFeB magnet powder with resin. The outer peripheral face 141 fits snugly against an inner surface of the outer cylindrical wall 12A, and is also secured by cement. As shown in FIG. 1, the bond magnet 14 has north and south poles produced by magnetization. Upper and lower (first and second) end portions of the bond magnet 14 protrude inwardly toward upper and lower end portions of the magnetic member 13. The inner peripheral faces 142 and 143 of these protruding end portions and the outer peripheral face 132 of the ring-shaped magnetic member 13 define therebetween two magnetic gaps 152 and 153.

Accordingly, since the magnetic member 13 is fitted over the inner cylindrical portion 12C and the ring-shaped bond magnet 14 is fitted into the recess section 114 between the outer cylindrical wall 12A and the magnetic member 13, it is not necessary to use a special jig to position and mount the magnetic member 13 coaxially with the magnet 14. This allows accurate formation of the magnetic gaps 152 and 153, which makes assembly much easier and, therefore, less expensive.

The voice coils 162 and 163, which are wound upon the cylindrical bobbin 17, are positioned in the magnetic gaps 152 and 153, respectively. Each of the voice coils 162 and 163 is connected in series or parallel and wound such that current flow through the voice coils 162 and 163 produces a bobbin driving force which is exerted in a common axial direction. In other words, when the bobbins are connected in series, the voice coils 162 and 163 are respectively wound in opposite directions. On the other hand, when they are connected in parallel, the voice coils 162 and 163 are wound in opposite directions or in the same direction so that current will flow in the opposite direction when voice current is supplied. This causes each of the voice coils 162 and 163 to be driven in the same direction. When the voice coils 162 and 163 are connected in parallel, their total inductance is one-half that when they are connected in series, so that low impedance in the high-frequency region can be realized.

Figure 7:
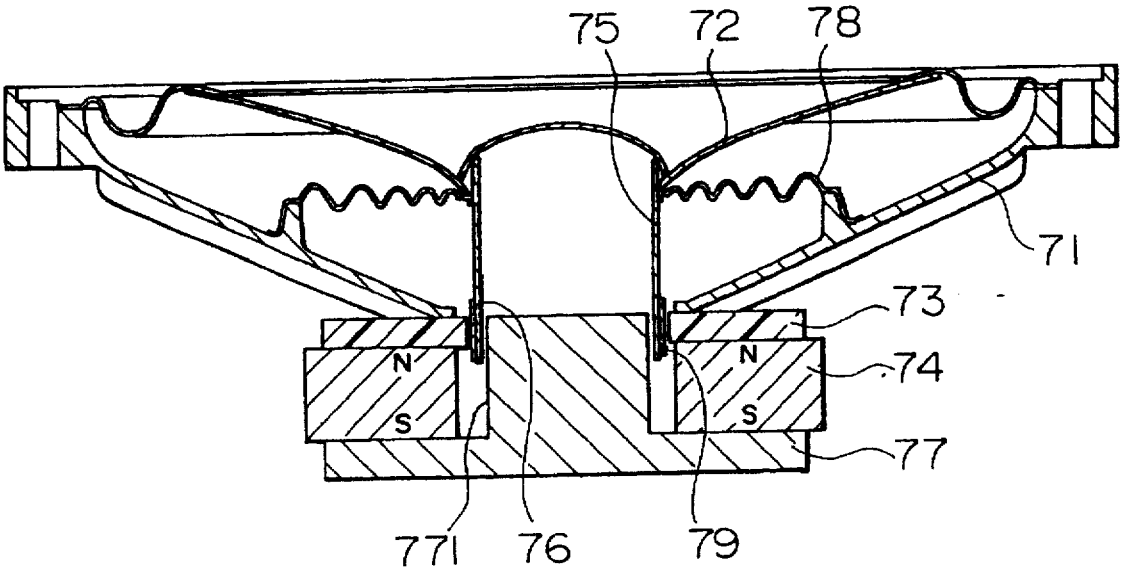
FIG. 7 is section view showing a conventional speaker.
Figure 8:
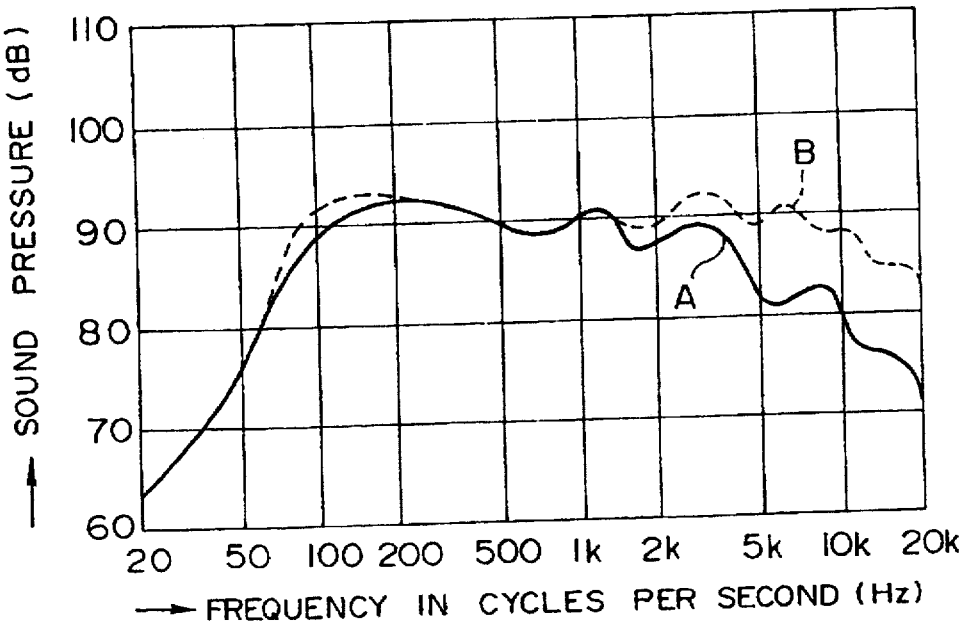
FIG. 8 is a diagram illustrating output sound pressure characteristics of a speaker according to the present invention and a conventional speaker.
Figure 9:
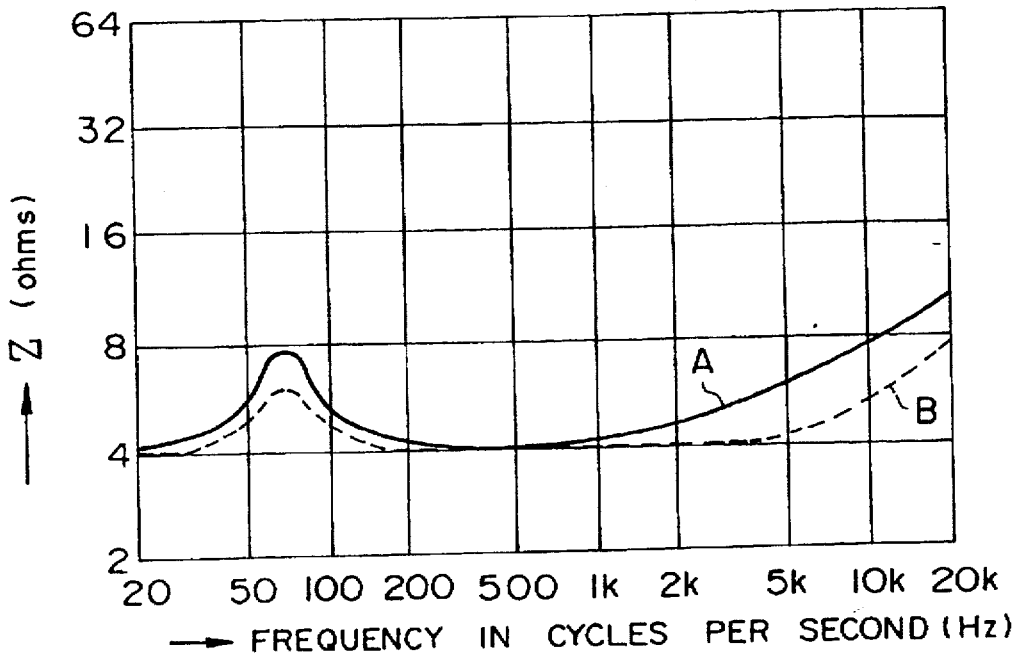
FIG. 9 is a diagram illustrating impedance characteristics of the speaker according to the present invention and the conventional speaker.
Figure 10:
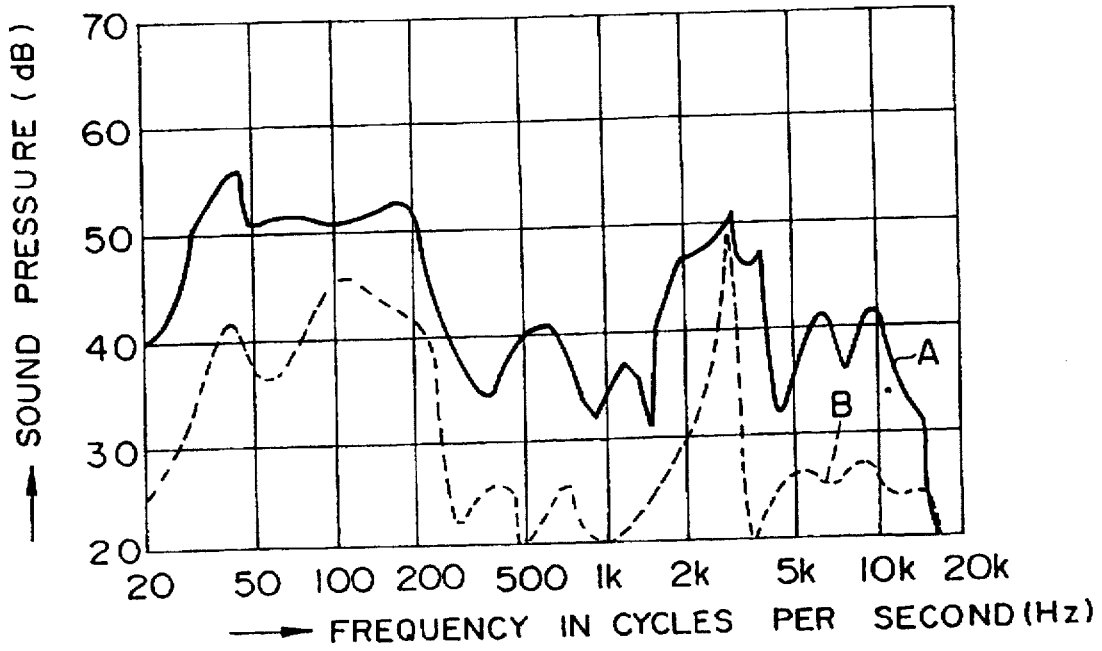
FIG. 10 is a diagram illustrating high-frequency secondary distortion characteristics of the speaker according to the present invention and the conventional speaker.
Figure 11:
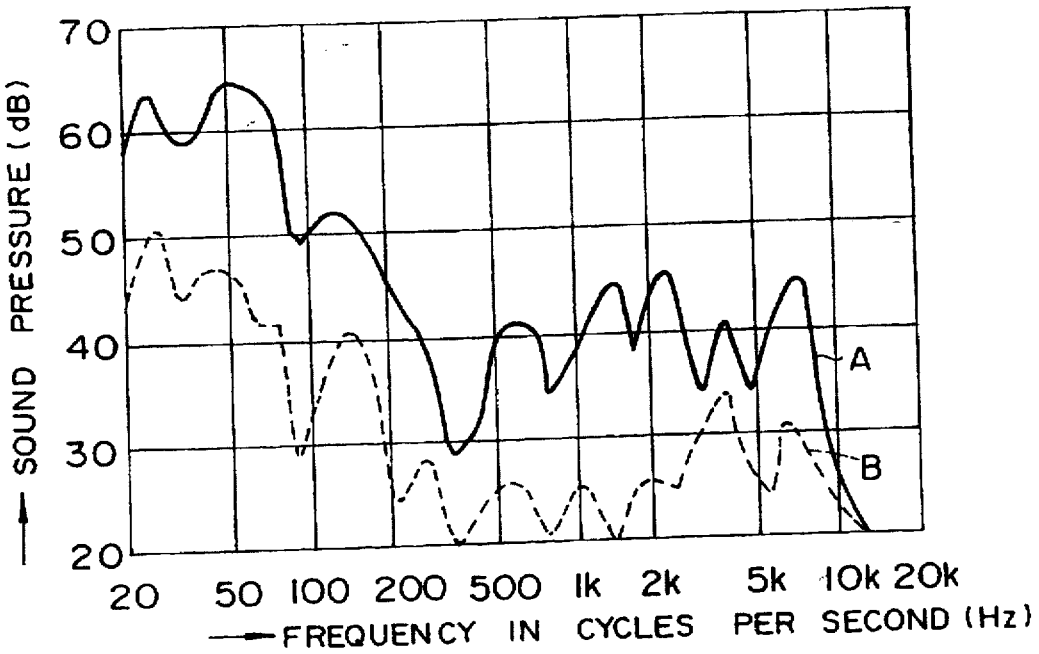
FIG. 11 is a diagram illustrating high-frequency tertiary distortion characteristics of the speaker according to the present invention and the conventional speaker.

FIGS. 8 through 11 each illustrate characteristic curves associated with the speaker according to the first embodiment shown in FIG. 1 and characteristic curves associated with the conventional speaker of FIG. 7. FIG. 8 is a diagram illustrating output sound pressure characteristics, FIG. 9 is a diagram illustrating impedance characteristics, FIG. 10 is a diagram illustrating high-frequency secondary distortion characteristics, and FIG. 11 is a diagram illustrating high-frequency third order distortion characteristics. In these figures, solid line (A) indicates the characteristic of the conventional speaker, while dotted line (B) indicates the characteristic of the speaker according to the present invention. Referring to FIG. 8, the speaker according to the present invention has less noise level reduction, particularly in the high-frequency band than the conventional speaker. Referring to FIG. 9, it is apparent that the speaker according to the present invention has less variations in impedance over the entire frequency range than exhibited in the conventional speaker. As in FIGS. 10 and 11, the speaker according to the present invention has significantly reduced high-frequency secondary and third order distortions than the conventional speaker. According to the first embodiment in which the magnetic circuit is formed by the magnetic member 13, which is made of a soft ferrite core, and the bond magnet 14, having NdFeB magnet powder bonded thereon with resin, it is not necessary to use the iron plate 73 and yoke 77 as has been the case for the conventional speaker of FIG. 7. Therefore eddy currents are not produced in the magnetic circuit as a result of current supplied to the voice coils 162 and 163, thereby preventing an increase in the impedance of the voice coils 162 and 163 in the high-frequency region. This allows reproduction of sound having little distortion at a high sound pressure level in regions up to the high-frequency region.

Figure 12:
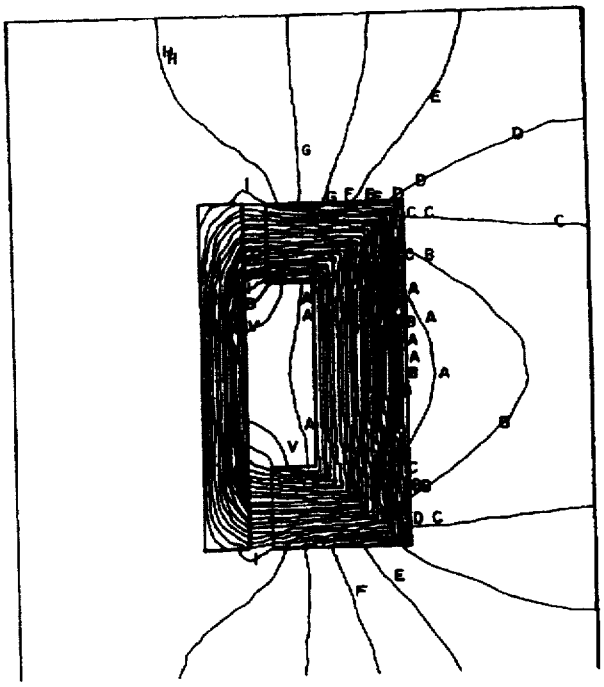
FIG. 12 is a diagram illustrating leakage flux simulation results of the magnetic circuit of the speaker according to the present invention.
Figure 13:
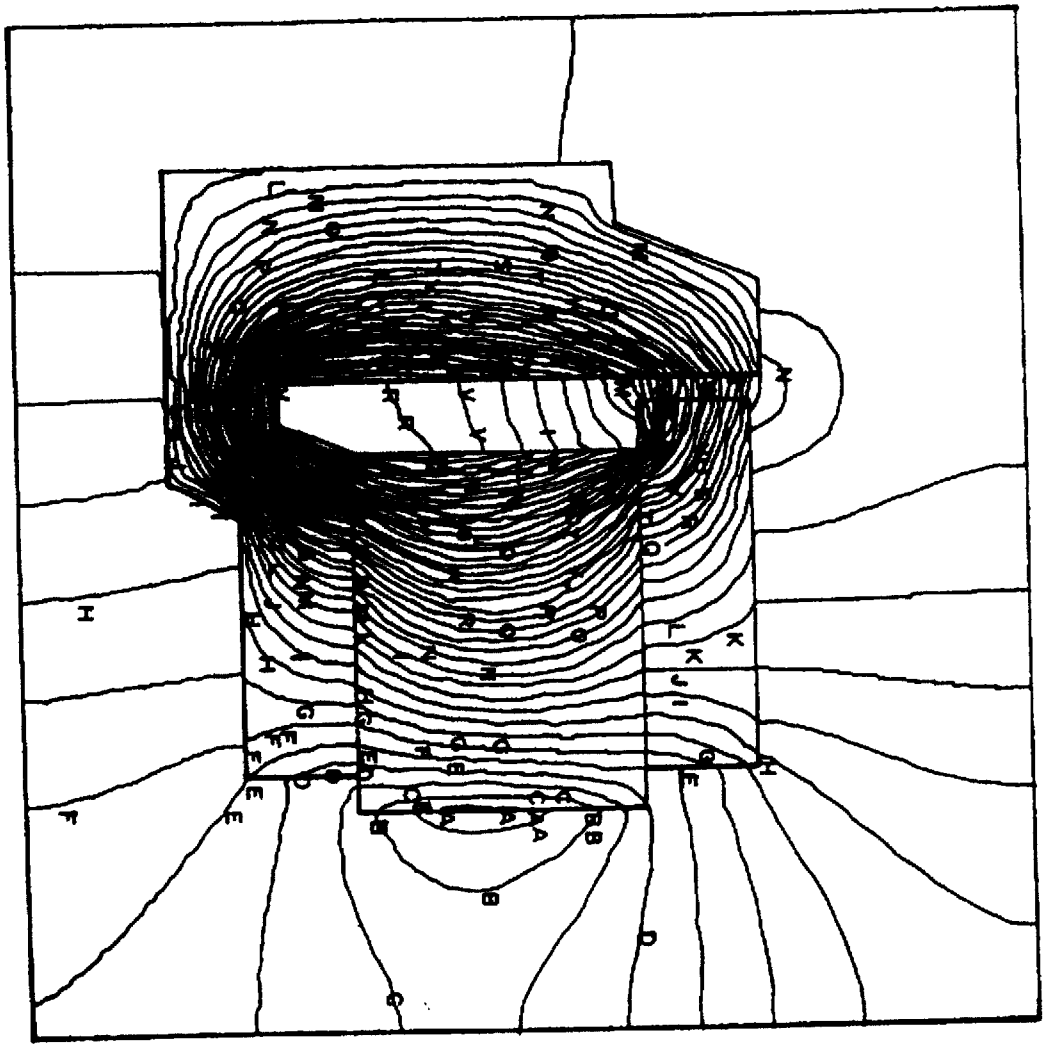
FIG. 13 is a diagram illustrating leakage flux simulation results of the magnetic circuit of the conventional speaker.

FIGS. 12 and 13 each illustrate leakage flux simulation results of the magnetic circuit of the speaker according to the present invention and that of the conventional speaker, respectively. The magnetic circuit of the speaker according to the present invention of FIG. 1 has magnetic gaps 152 and 153 directly formed between the peripheral face of the magnetic member 13 and that of the bond magnet 14. For this reason, as shown in FIG. 12, it has considerably less leakage flux and a high conversion efficiency compared to the magnetic circuit of the conventional speaker, in which the direction of the magnetic field developed by the magnet is changed based on the high magnetic permeability of iron, as shown in FIG. 13. The magnet forming the magnetic circuit may be made of neodymium, iron, boron, or the like to develop a high flux density in the magnetic gaps 152 and 153. However, if a bond magnet including rare earth metal powder is used as in the embodiment, development of eddy currents in the magnet can be prevented, and the direction of the magnetic flux which travels through the magnet interior may be freely determined by varying the magnetization.

Second Embodiment

Figure 2:
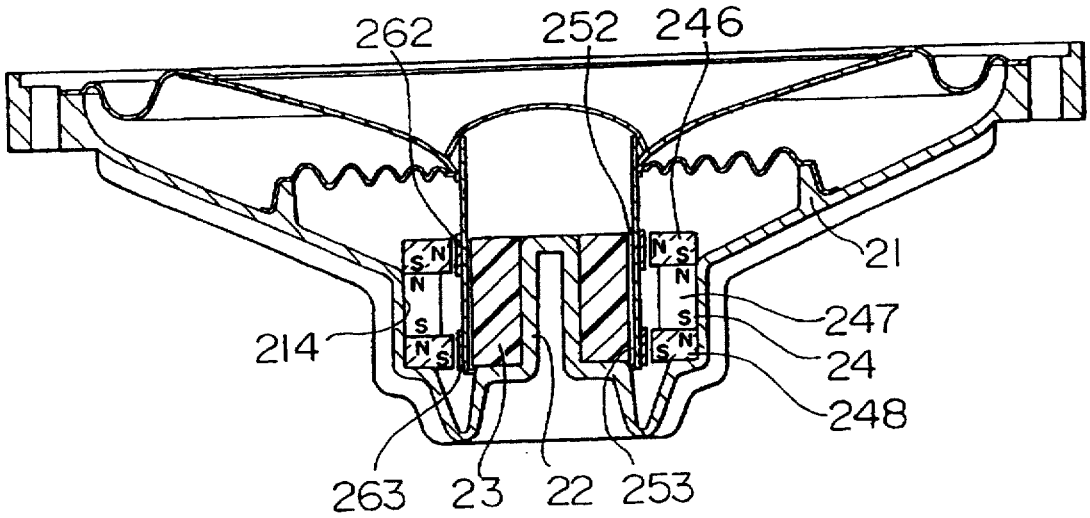
FIG. 2 is a section view showing a speaker according to a second embodiment of the present invention.

FIG. 2 is a cross section of a speaker according to a second embodiment of the present invention. The details of the frame, diaphragm, damper, and bobbin are the same as those described in the aforementioned first embodiment, so they will not be described in detail below.

Referring to FIG. 2, a magnet structure 24 includes a cylindrical soft ferrite core 247 and a pair of ring-shaped bond magnets 246 and 247, each of which has bonded thereon NdFeB magnet powder with resin, integrally joined to the upper and low ends of the soft ferrite core 247. As shown in FIG. 2, the ring-shaped bond magnets 246 and 248 have a smaller inner diameter than the soft ferrite core 247, and are magnetized to form north and south poles in the diameter dimension. Magnetic flux travels through the soft ferrite core 247 between the upper bond magnet 246 and the lower bond magnet 248. In the magnet structure 24, the outer peripheral face of one of the lower bond magnet 248 and that of the soft ferrite core 247 are received into the recess section 214 of frame 21, and are secured to the frame 21 by cement. The inner peripheral face of a ring-shaped soft ferrite core 23 is mounted over the cylindrical portion 22 protruding from the bottom portion of the frame 21, and is secured to the frame by cement. Two magnetic gaps 252 and 253 are formed between the outer peripheral face of the ferrite core 23 and the inner peripheral faces of the bond magnets 246 and 248. Voice coils 262 and 263 are inserted in the magnetic gaps 252 and 253, respectively. The voice coils 262 and 263 are wound so that the resulting bobbin drive forces produced by the voice coils in response to an applied voice current are in a common axial direction. When connected in parallel in low frequency speaker applications, the voice coils 262 and 263 are have one-half of the inductance as compared to high frequency speaker applications in which the voice coils are connected in series.

As a variation to the magnet structure 24 of the second embodiment, a cylindrical bond magnet may be used instead of the soft ferrite core 247, and ring-shaped soft ferrite cores may be used in place of the ring-shaped magnets 246 and 248.

Third Embodiment

Figure 3:
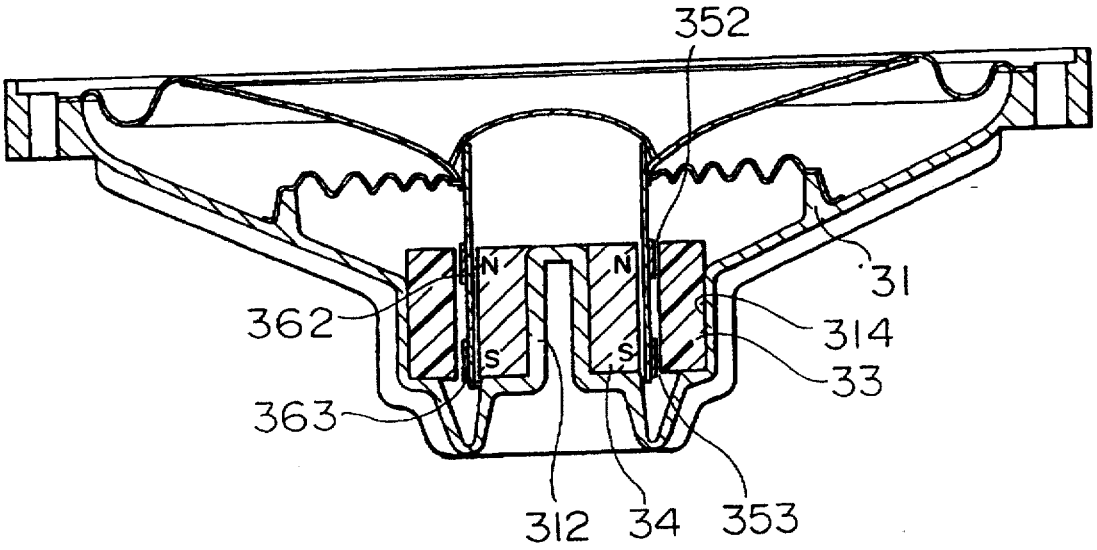
FIG. 3 is a section view showing a speaker according to a third embodiment of the present invention.

FIG. 3 is a cross section of a speaker according to a third embodiment of the present invention. The details of the frame, vibratory diaphragm, damper, and bobbin are the same as those described in the first embodiment. Therefore, they will not be described in detail below.

Referring to FIG. 3, reference numeral 33 denotes a ring-shaped soft ferrite core. Its outer peripheral face is received in a recess section of the frame 31, and is secured to the inner wall 314 by cement. An inner peripheral face of a cylindrical NdFeB magnet 34 is fitted over a cylindrical portion 312 projecting from the bottom wall of the frame 31, and is also secured by cement. The ring-shaped NdFeB magnet 34 has north and south poles in the illustrated vertical dimension. Two magnetic gaps 352 and 353 are formed between the outer peripheral face of the upper and lower end portions of the ring-shaped NdFeB magnet 34 and the inner peripheral face of the ring-shaped soft ferrite core 33. Voice coils 362 and 363 are inserted respectively in the magnetic gaps 352 and 353. Electric power is supplied to each of the voice coils 362 and 363 so that the direction of drive force of each voice coil is the same. The voice coils 362 and 363 connected in parallel have one-half the inductance compared to those connected in series. This allows low impedance to be realized in regions up to the high-frequency region.

In FIG. 3, a cylindrical NdFeB magnet may be disposed in place of the soft ferrite core 33. In addition, a soft ferrite core may be disposed in place of the NdFeB magnet 34. Further, the two magnetic gaps may be formed between the inner peripheral faces of the upper and lower end portions of the NdFeB magnet and the outer peripheral face of the soft ferrite core.

Fourth Embodiment

Figure 4:
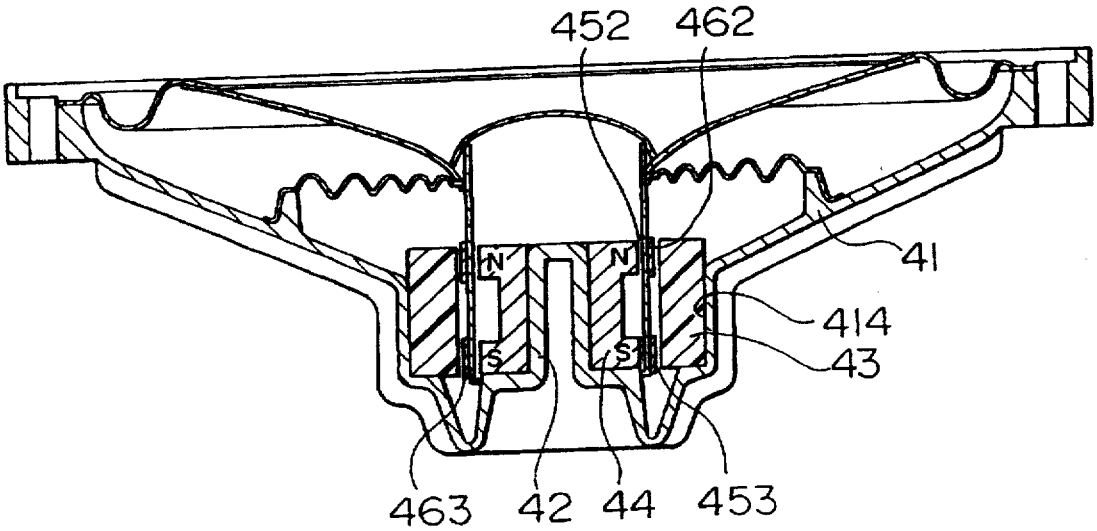
FIG. 4 is a section view showing a speaker according to a fourth embodiment of the present invention.

FIG. 4 is a cross section of a speaker according to a fourth embodiment of the present invention. The details of the frame, vibratory diaphragm, damper, and bobbin are the same as those described in the first embodiment. Therefore, they will not be described in detail below.

FIG. 4 is a cross section of a speaker according to a fourth embodiment of the present invention. Details of the frame, vibratory diaphragm, damper, and bobbin are the same as those described in the first embodiment, so that these will not be described in detail below.

Referring to FIG. 4, reference numeral 43 denotes a cylindrical soft ferrite core whose outer peripheral face is fitted into recess section 414 of the bottom portion of frame 41. It is secured within the frame 41 by cement. The inner peripheral face of cylindrical bond magnet 44 is fitted over cylindrical portion 42 protruding from the bottom wall of the frame 41 and secured by cement. Bond magnet 44 has its top and bottom end portions protruding outward and has a virtually I-shaped cross section. The ring-shaped bond magnet 44 has north and south poles in the illustrated vertical dimension formed by magnetization. Two magnetic gaps 452 and 453 are formed between the outer peripheral faces of the top and bottom end portions of the ring-shaped bond magnet 44 and the inner peripheral face of the ring-shaped soft ferrite core 43. Voice coils 462 and 463 are inserted into the magnetic gap 452 and 463, respectively. Electric power is supplied to these voice coils so that the bobbin drive force produced by each voice coil is in a common direction. Voice coils 462 and 463 connected in parallel have one-half the inductance of those connected in series, so that low impedance in a high-frequency range can be achieved.

In FIG. 4, a cylindrical bond magnet may be used in place of the soft ferrite core 43. In addition, a cylindrical soft ferrite core formed into a virtually I-shaped cross section may be used in place of the ring-shaped bond magnet 44. Further, two magnetic gaps may be formed between the outer peripheral faces of the top and bottom end portions of this ring-shaped soft ferrite core and the inner peripheral face of the ring-shaped bond magnet.

Fifth Embodiment

Figure 5:
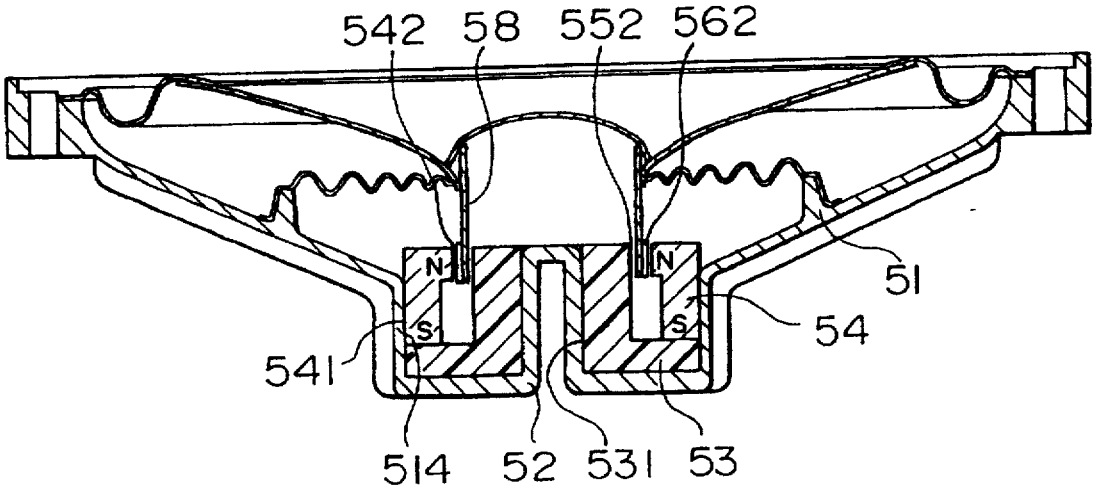
FIG. 5 is a section view showing a speaker according to a fifth embodiment of the present invention.

FIG. 5 is a cross sectional view of a speaker according to a fifth embodiment of the present invention. Details of the vibratory diaphragm and damper are the same as those described in the first embodiment, so that these will not be described in detail below.

In accordance with the fifth embodiment, a frame 51 is formed virtually into the shape of a bowl from synthetic resin such as ABS or aluminum die-cast. The frame 51 includes at its the bottom portion a base 52 which includes a central cylindrical member which protrudes upward from a bottom wall. A recess section 514, which is a virtually W-shaped cross section, is formed by the outer side wall, the bottom wall and the cylindrical portion of the cylindrical portion 52. The cylindrical portion 52 and the recess section 514 are coaxially formed with each other. Space 115 located below the recess section 114 of the frame 11 illustrated in FIG. 1 is not provided in the frame 51 of this embodiment.

Inner peripheral face 531 of soft ferrite core 53 is received over the cylindrical portion of the base 52 and secured by cement. The illustrated lower end portion of the soft ferrite core 53 protrudes outward in the form of a flange. Bond magnet 54 is fixed on this protruding flange. An outer peripheral face 541 of the bond magnet 54 is received in the recess section 514 of the frame 51 and secured by cement. The illustrated upper end portion of the bond magnet 54 protrudes inwardly in the form of a flange. The protruding portion and the illustrated bottom end portion are magnetized to form north and south poles. A single magnetic gap 552 is formed between the upper end inner peripheral face 542 and the outer peripheral face of the upper portion of the soft ferrite core 53.

Voice coil 562, which is wound upon a cylindrical bobbin 58, is inserted in the magnetic gap 552. Passing voice current through this voice coil 562 causes vibration of the vibratory diaphragm in the illustrated vertical direction, thereby producing sound.

Sixth Embodiment

Figure 6:
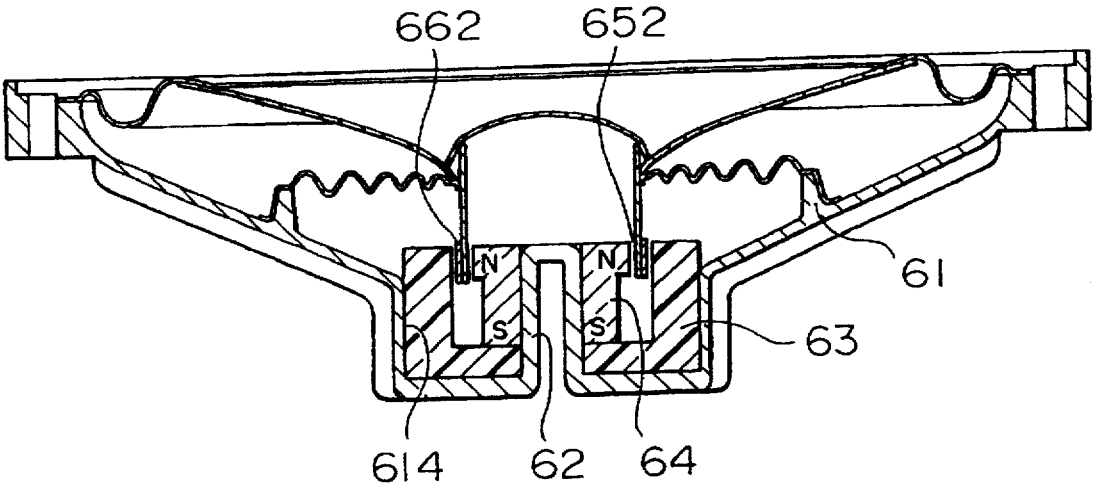
FIG. 6 is a section view showing a speaker according to a sixth embodiment of the present invention.

FIG. 6 is a cross sectional view of a speaker according a sixth embodiment of the present invention. The vibratory diaphragm and damper of the sixth embodiment are the same as those described in the first embodiment, and those of the frame and the bobbin are the same as those described in the fifth embodiment. Therefore, these will not be described in detail below.

The outer peripheral face of soft ferrite core 63 is fitted into a recess section 614 formed in a base 62 of a frame 61, and is secured by cement. The illustrated lower end portion of the soft ferrite core 63 protrudes inwardly to form a flange on which is fixedly placed ring-shaped bond magnet 64. The inner peripheral face of the ring-shaped bond magnet 64 is received over a cylindrical portion of the base 62, and is secured by cementing. The illustrated upper end portion of the ring-shaped bond magnet 64 protrudes outwardly in the form of a flange. The protruding portion and the illustrated lower end portion are magnetized to form north and south poles. A single magnetic gap 652 is formed between the upper end outer peripheral face of the bond magnet 64 and the inner peripheral face of the upper portion of the soft ferrite core 63. Voice coil 662 is inserted in this magnetic gap 652.

According to the present invention, it is possible to reduce the amount of eddy currents developed by the magnetic field of the voice coil produced by voice current (alternating current) flowing therethrough, and thereby to reduce sound distortion. This is because the magnetic member, forming one face of the magnetic gap, is a ferrite core of a light-weight oxide, such as Mnzn ferrite, Nizn ferrite, or the like.

Directly forming the magnetic gap between the peripheral faces of the magnet and the magnetic member reduces leakage flux, which results in higher magnetic flux efficiency. In addition, it is not necessary to use a plurality of magnetic members (ring-shaped plate 73 and yoke 77), so that fewer parts are used, thereby simplifying assembly.

A reduction in the amount of iron powder produced during assembly further simplifies assembly. This is because the cylindrical magnet structure and the cylindrical magnetic member, which are disposed coaxially, are secured with the bottom portion of the frame, making it unnecessary to connect the frame and the magnetic circuit by an iron powder producing method, such as caulking.

What is claimed is:

1. A speaker comprising:

a frame having a base integrally connected to a cone member, the cone member having a narrow end connected to the base and a wide end, a magnetic circuit connected to the base, the magnetic circuit including a magnet structure and a magnetic member disposed coaxially with the magnet structure, a vibratory diaphragm having an outer edge connected to the wide end of the cone, the vibratory diaphragm having an inner edge, a cylindrical bobbin connected to the inner edge of the vibratory diaphragm, the cylindrical bobbin extending in an axial direction, and a plurality of voice coils wound upon the bobbin and spaced apart in the axial direction, wherein a plurality of coaxial ring-shaped magnetic gaps are formed between peripheral faces of the magnet structure and the magnetic member, each of the plurality of magnetic gaps having a common gap distance separating the magnet structure and the magnetic member, wherein each of the plurality of voice coils is positioned in one of the plurality of magnetic gaps, and wherein the plurality of voice coils are wound such that current flow through the voice coils produces driving forces which are exerted on the voice coils in a common axial direction.

2. A speaker according to claim 1, wherein the magnetic member is a ferrite core.

3. A speaker according to claim 1, wherein the base of the frame includes an outer cylindrical portion connected to the cone, a bottom wall connected to the outer cylindrical portion, and an inner cylindrical portion connected to the bottom wall such that a recess is formed between the outer cylindrical portion and the inner cylindrical portion, wherein the magnet structure includes an outer peripheral surface which is smaller in diameter than an inner peripheral surface of the magnetic member, the magnetic gaps being formed between the outer peripheral surface of the magnet structure and the inner peripheral surface of the magnetic member, and wherein the magnet structure and the magnetic member are positioned in the recess formed by the base, the magnet structure having a central opening receiving the inner cylindrical portion, and the magnetic member having an outer peripheral surface contacting an inner surface of the outer cylindrical portion of the base.

4. A speaker according to claim 1, wherein the magnet structure comprises a bonded magnet including a rare earth metal powder.

5. A speaker according to claim 1, wherein the magnet structure includes a first ring-shaped magnet and a second ring-shaped magnet co-axially disposed on opposite ends of a cylindrical core.

6. A speaker according to claim 5, wherein the ring-shaped magnets are integrally connected to the cylindrical core.

7. A speaker according to claim 1, wherein the base of the frame includes an outer cylindrical portion connected to the cone, a bottom wall connected to the outer cylindrical portion, and an inner cylindrical portion connected to the bottom wall such that a recess is formed between the outer cylindrical portion and the inner cylindrical portion, wherein the magnetic member includes an outer peripheral surface which is smaller in diameter than an inner peripheral surface of the magnet structure, the magnetic gaps being formed between the outer peripheral surface of the magnetic member and the inner peripheral surface of the magnet structure, and wherein the magnetic member and the magnet structure are positioned in the recess formed by the base, the magnetic member having a central opening receiving the inner cylindrical portion, and the magnet structure having an outer peripheral surface contacting an inner surface of the outer cylindrical portion of the base.

8. A speaker according to claim 1, wherein the magnet structure includes an outer peripheral surface which is smaller in diameter than an inner peripheral surface of the magnetic member, the plurality of magnetic gaps being formed between the outer peripheral surface of the magnet structure and the inner peripheral surface of the magnetic member.

9. A speaker according to claim 1, wherein the magnetic member includes an outer peripheral surface which is smaller in diameter than an inner peripheral surface of the magnet structure, the magnetic gaps being formed between the outer peripheral surface of the magnetic member and the inner peripheral surface of the magnet structure.

10. A speaker comprising:

a frame having a base integrally connected to a cone member, the cone member having a narrow end connected to the base and a wide end, a magnetic circuit connected to the base and forming a magnetic gap, a vibratory diaphragm having an outer edge connected to the wide end of the cone, the vibratory diaphragm having an inner edge, a cylindrical bobbin connected to the inner edge of the vibratory diaphragm, and a voice coil wound upon the bobbin and inserted in the magnetic gap of the magnetic circuit, wherein the magnetic circuit includes a magnet structure and a magnetic member disposed coaxially with the magnet structure, wherein the base of the frame includes an outer cylindrical portion connected to the cone, a bottom wall connected to the outer cylindrical portion, and an inner cylindrical portion connected to the bottom wall such that a recess is formed between the outer cylindrical portion and the inner cylindrical portion, wherein the magnetic member includes an outer peripheral surface which is smaller in diameter than an inner peripheral surface of the magnet structure, the magnetic gap being formed between the outer peripheral surface of the magnetic member and the inner peripheral surface of the magnet structure, and wherein the magnetic member and the magnet structure are positioned in the recess formed by the base, the magnetic member having a central opening receiving the inner cylindrical portion, and the magnet structure having an outer peripheral surface contacting an inner surface of the outer cylindrical portion of the base.

11. A speaker according to claim 10, wherein the magnet structure and the magnetic member form a plurality of coaxial ring-shaped magnetic gaps including said magnetic gap, wherein the voice coil includes a plurality of voice coil portions, each voice coil portion being positioned in one of the plurality of magnetic gaps, and wherein the voice coil portions are wound such that current flow through the voice coil portions produces an electro-magnetic force which is exerted on the voice coil portions in a common axial direction.

12. A speaker according to claim 10, wherein the magnet structure comprises a bonded magnet including a rare earth metal powder.

13. A speaker according to claim 10, wherein the magnet structure includes a first ring-shaped magnet and a second ring-shaped magnet co-axially disposed on opposite ends of a cylindrical core.

14. A speaker according to claim 13, wherein the ring-shaped magnets are integrally connected to the cylindrical core.

15. A speaker according to claim 10, wherein the magnetic member is a ferrite core.

16. A speaker comprising:

a frame having a base integrally connected to a cone member, the base including an outer cylindrical portion, a bottom wall connected to the outer cylindrical portion, and an inner cylindrical portion connected to the bottom wall such that a recess is formed between the outer cylindrical portion and the inner cylindrical portion, the cone member having a narrow end connected to the outer cylindrical portion and a wide end, a magnetic circuit received in the recess of the base and forming a magnetic gap, a vibratory diaphragm having an outer edge connected to the wide end of the cone, the vibratory diaphragm having an inner edge, a cylindrical bobbin connected to the inner edge of the vibratory diaphragm, and a voice coil wound upon the bobbin and being positioned in the magnetic gap of the magnetic circuit, wherein the magnetic circuit includes a magnet structure and a magnetic member disposed coaxially with the magnet structure, the magnetic gap being formed between peripheral faces of the magnet structure and the magnetic member, wherein the magnet structure includes an outer peripheral surface which is smaller in diameter than an inner peripheral surface of the magnetic member, the magnetic gap being formed between the outer peripheral surface of the magnet structure and the inner peripheral surface of the magnetic member, wherein the magnetic member and the magnet structure are positioned in the recess formed by the base, the magnet structure having a central opening receiving the inner cylindrical portion, and the magnetic member having an outer peripheral surface contacting an inner surface of the outer cylindrical portion of the base.

17. A speaker according to claim 16, wherein the magnetic member is a ferrite core.

18. A speaker according to claim 16, wherein the magnet structure comprises a bonded magnet including a rare earth metal powder.

19. A speaker according to claim 16, wherein the magnetic member and the magnet structure form a plurality of coaxial ring-shaped magnetic gaps including said magnetic gap, wherein the voice coil includes a plurality of voice coil portions, each voice coil portion being positioned in one of the plurality of magnetic gaps, and wherein the voice coil portions are wound such that current flow through the voice coil portions produces an electro-magnetic force which is exerted on the voice coil portions in a common axial direction.

* * * * *